US011118538B2

(12) United States Patent
Nakagawa

(10) Patent No.: US 11,118,538 B2
(45) Date of Patent: Sep. 14, 2021

(54) EVAPORATED FUEL PROCESSING DEVICE AND CONTROL DEVICE

(71) Applicant: AISAN KOGYO KABUSHIKI KAISHA, Obu (JP)

(72) Inventor: Makoto Nakagawa, Nagoya (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 0 days.

(21) Appl. No.: 16/620,172

(22) PCT Filed: May 15, 2018

(86) PCT No.: PCT/JP2018/018806

§ 371 (c)(1),
(2) Date: Dec. 6, 2019

(87) PCT Pub. No.: WO2018/230231

PCT Pub. Date: Dec. 20, 2018

(65) Prior Publication Data

US 2020/0141361 A1 May 7, 2020

(30) Foreign Application Priority Data

Jun. 13, 2017 (JP) ..... JP2017-116236

(51) Int. Cl.
*F02M 25/08* (2006.01)

(52) U.S. Cl.
CPC ..... *F02M 25/0827* (2013.01); *F02M 25/089* (2013.01); *F02M 25/0836* (2013.01)

(58) Field of Classification Search
CPC ..... F02D 29/02; F02D 41/004; F02M 25/08; F02M 25/0818; F02M 25/0827; F02M 25/0836; F02M 25/089; F02M 69/34
See application file for complete search history.

(56) References Cited

U.S. PATENT DOCUMENTS 5,881,700 A 3/1999 Gras et al.
7,316,225 B2 1/2008 Murakami
(Continued)

FOREIGN PATENT DOCUMENTS

JP H7-247918 A 9/1995
JP H9-079096 A 3/1997
(Continued)

OTHER PUBLICATIONS

International Search Report (ISR) for PCT/JP2018/018806 dated Aug. 7, 2018 (4 pages total including English translation).
(Continued)

*Primary Examiner* — John Kwon
*Assistant Examiner* — Johnny H Hoang
(74) *Attorney, Agent, or Firm* — Shumaker, Loop & Kendrick, LLP

(57) ABSTRACT

An evaporated fuel processing device includes a canister to which evaporated fuel generated in a fuel tank adheres; a purge passage passed through purge gas and connecting the canister and an intake pipe of an engine; a purge control valve provided on the purge passage and controlling a supply amount of the purge gas to the intake pipe by changing a duty cycle; a pump provided on the purge passage and feeding the purge gas from the canister to the intake pipe; and a controller control the duty cycle of the purge control valve. The controller detects a pressure difference between pressures at upstream and downstream ends of the purge passage while the purge gas is supplied, and corrects the duty cycle based on a supply amount of the purge gas with respect to the duty cycle with no influence of the pump, by using the detected pressure difference.

3 Claims, 3 Drawing Sheets

(56) References Cited

U.S. PATENT DOCUMENTS

| | | | | |
|---|---|---|---|---|
| 9,989,019 | B2 | 6/2018 | Makino | |
| 10,294,895 | B2 | 5/2019 | Shirai | |
| 10,415,511 | B2 | 9/2019 | Makino et al. | |
| 2007/0119427 | A1* | 5/2007 | Murakami | F02M 25/0818 123/520 |
| 2008/0092858 | A1* | 4/2008 | Satoh | F02M 25/0809 123/520 |
| 2011/0308302 | A1* | 12/2011 | Makino | F02M 25/0836 73/40.7 |
| 2013/0031937 | A1 | 12/2013 | Haag et al. | |
| 2013/0319378 | A1 | 12/2013 | Haag et al. | |
| 2016/0108864 | A1* | 4/2016 | Tochihara | F02M 25/089 123/520 |
| 2016/0326990 | A1* | 11/2016 | Pursifull | F02M 25/06 |
| 2018/0347511 | A1* | 12/2018 | Makino | F02D 41/0032 |
| 2019/0101082 | A1* | 4/2019 | Sanuma | F02D 41/0045 |
| 2019/0113007 | A1* | 4/2019 | Kato | F02M 25/0809 |
| 2019/0145354 | A1* | 5/2019 | Kato | F02D 41/004 123/520 |
| 2019/0242331 | A1* | 8/2019 | Kato | F02M 25/089 |
| 2019/0285011 | A1* | 9/2019 | Asanuma | F02M 25/08 |
| 2019/0301403 | A1* | 10/2019 | Asanuma | F02D 41/0045 |
| 2019/0331036 | A1* | 10/2019 | Asanuma | F02D 41/0045 |
| 2019/0360434 | A1* | 11/2019 | Dudar | F02D 41/004 |

FOREIGN PATENT DOCUMENTS

| | | | |
|---|---|---|---|
| JP | 2007-146797 | A | 6/2007 |
| JP | 2016-020675 | A | 2/2016 |
| JP | 2016-164384 | A | 9/2016 |
| JP | 2016-217172 | A | 12/2016 |

OTHER PUBLICATIONS

Written Opinion for PCT/JP2018/018806 dated Aug. 7, 2018 (9 pages including English Translation).

* cited by examiner

EVAPORATED FUEL PROCESSING DEVICE AND CONTROL DEVICE

TECHNICAL FIELD

The disclosure herein relates to an evaporated fuel processing device mounted on a vehicle and a controller.

BACKGROUND ART

Evaporated fuel processing devices that supply evaporated fuel generated in a fuel tank to an engine and processes it are known. In Japanese Patent Application Publication No. H7-247918, evaporated fuel adheres to a canister, and purge gas containing the evaporated fuel is supplied to an engine. Hereinafter, Japanese Patent Application Publication No. H7-247918 is referred to as Patent Document 1. A supply amount of the purge gas is controlled by controlling a purge control valve based on its duty cycle. In Patent Document 1, the duty cycle of the purge control valve is corrected based on a temperature in a fuel tank and a pressure in the fuel tank.

SUMMARY OF INVENTION

Patent Document 1 detects a generated amount of the evaporated fuel by detecting the temperature and pressure in the fuel tank, corrects the duty cycle according to the generated amount of evaporated fuel, and adjusts the supply amount of purge gas. This control method is useful when the duty cycle of the purge control valve is proportional to the supply amount of purge gas. However, in recent years, a pump that feeds purge gas to a purge passage may be disposed in order to ensure supply of the purge gas to an engine, and in the case of an evaporated fuel processing device provided with such pump, the conventional relationship (proportional relationship) between the duty cycle and the supply amount of purge gas cannot be utilized. The disclosure herein discloses a technique for supplying a desired amount of purge gas to an engine in an evaporated fuel processing device comprising a pump.

A first technique disclosed herein relates to an evaporated fuel processing device. The evaporated fuel processing device may comprise a canister to which evaporated fuel generated in a fuel tank adheres; a purge passage connecting the canister and an intake pipe of an engine, and through which purge gas to be delivered from the canister to the intake pipe passes; a purge control valve provided on the purge passage and configured to control a supply amount of the purge gas to the intake pipe by changing a duty cycle; a pump provided on the purge passage and configured to feed the purge gas from the canister to the intake pipe; and a controller configured to control the duty cycle of the purge control valve. The controller may detect a pressure difference between a pressure at an upstream end of the purge passage and a pressure at a downstream end of the purge passage while the purge gas is supplied. The controller may connect the duty cycle based on a supply amount of the purge gas with respect to the duty cycle with no influence of the pump, by using the detected pressure difference.

A second technique disclosed herein is the evaporated fuel processing device of the first technique, wherein pressure sensors are provided at both the upstream end and the downstream end of the purge passage, respectively.

A third technique disclosed herein relates to a controller. The controller may be configured to control a purge control valve in an evaporated fuel processing means that supplies purge gas containing evaporated fuel generated in a fuel tank to an intake pipe of an engine. The evaporated fuel processing means may comprise: a canister to which evaporated fuel generated in the fuel tank adheres; a purge passage connecting the canister and the intake pipe of the engine, and through which purge gas to be delivered from the canister to the intake pipe passes; a purge control valve provided on the purge passage and configured to control a supply amount of the purge gas to the intake pipe by changing a duty cycle; and a pump provided on the purge passage and configured to feed the purge gas from the canister to the intake pipe. The controller may be configured to: detect a pressure difference between a pressure at an upstream end of the purge passage and a pressure at a downstream end of the purge passage while the purge gas is supplied; and connect the duty cycle based on a supply amount of the purge gas with respect to the duty cycle with no influence of the pump, by using the detected pressure difference.

Advantageous Effects of Invention

According to the first technique, in the evaporated fuel processing device comprising the pump, excessive introduction of the purge gas into the intake path can be suppressed only by substantially detecting the pressure difference between the upstream end and the downstream end of the purge passage (pressure loss in the purge passage). Thus, deviation of an air-fuel ratio in the engine from the control value can be suppressed.

According to the second technique, the pressure difference between the upstream end and the downstream end of the purge passage can be accurately detected without being affected by variations in external air pressure, variations in the pressure in the intake path, and the like.

According to the third technique, the first technique can be implemented.

DESCRIPTION OF EMBODIMENTS (Fuel Supply System)

Figure 1:
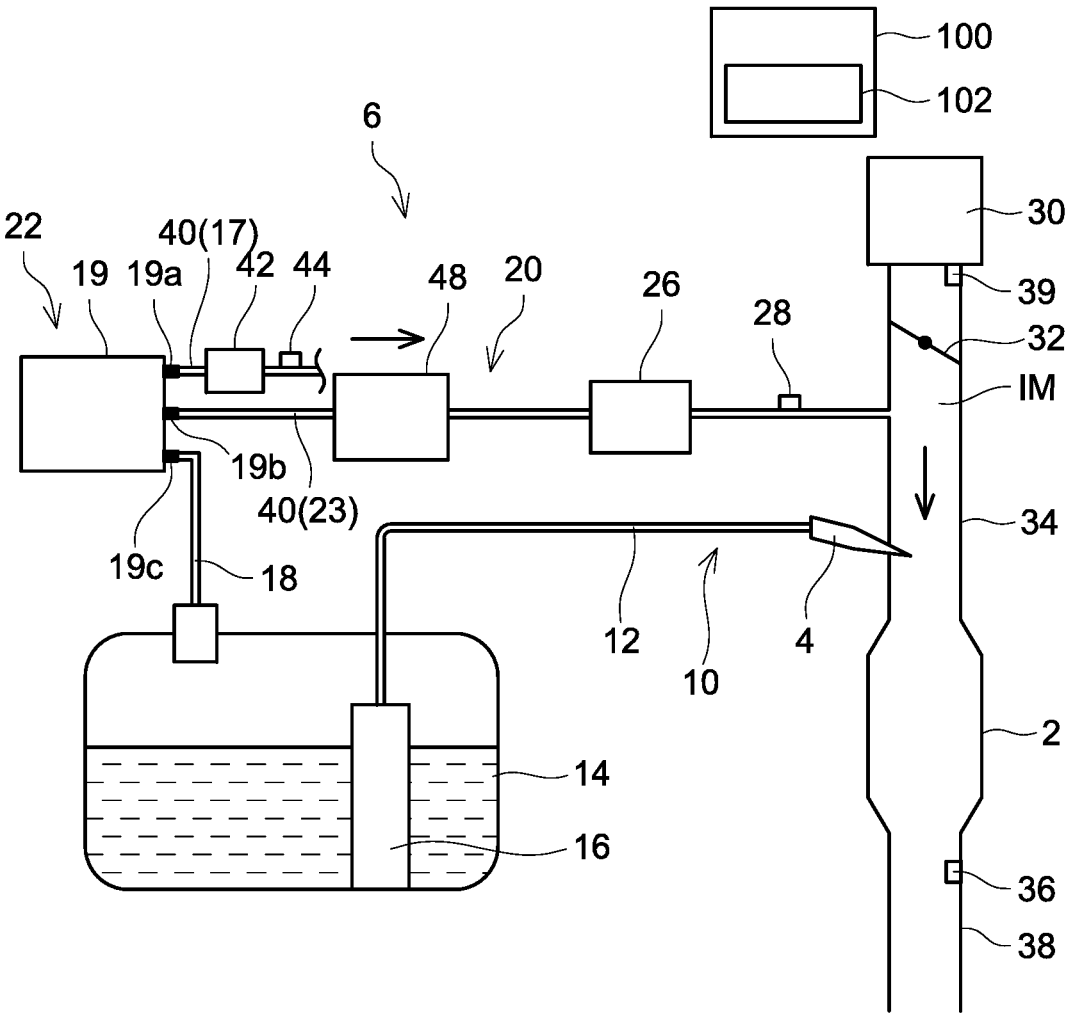
FIG. 1 shows a fuel supply system of a vehicle using an evaporated fuel processing device.

Referring to FIG. 1, a fuel supply system 6 including an evaporated fuel processing device 20 will be described. The fuel supply system 6 is mounted on a vehicle, and includes a main supply path 10 for supplying fuel stored in a fuel tank 14 to an engine 2 and an evaporated fuel path 22 for supplying evaporated fuel generated in the fuel tank 14 to the engine 2.

(Main Supply Passage)

The main supply path 10 is provided with a fuel pump unit 16, a supply path 12, and an injector 4. The fuel pump unit 16 includes a fuel pump, a pressure regulator, a control circuit, and the like. The fuel pump unit 16 is configured to control the fuel pump in accordance with signals supplied from an ECU 100. The fuel pump is configured to increase a pressure of the fuel in the fuel tank 14 and discharge it. The pressure of the fuel discharged from the fuel pump is regulated by the pressure regulator, and then the fuel is supplied from the fuel pump unit 16 to the supply path 12.

The supply path 12 is connected to the fuel pump unit 16 and the injector 4. The fuel supplied to the supply path 12 passes through the supply path 12 and reaches the injector 4. The injector 4 includes a valve (not shown) whose aperture is controlled by the ECU 100. When the valve of the injector 4 is opened, the fuel in the supply path 12 is supplied to an intake path 34 connected to the engine 2.

The intake path 34 is connected to an air cleaner 30. The air cleaner 30 includes a filter that removes foreign matter from air flowing into the intake path 34. In the intake path 34, a throttle valve 32 is provided between the engine 2 and the air cleaner 30. When the throttle valve 32 is opened, air is suctioned from the air cleaner 30 toward the engine 2 as shown by an arrow in FIG. 1. The ECU 100 adjusts an aperture of the throttle valve 32 to change an opening area of the intake path 34 and to adjust an amount of air flowing into the engine 2. The throttle valve 32 is provided upstream of the injector 4 (on air cleaner 30 side relative to the injector 40).

(Evaporated Fuel Path)

The evaporated fuel path 22 is disposed along the main supply path 10. The evaporated fuel path 22 is a path through which the evaporated fuel generated in the fuel tank 14 passes from the fuel tank 14 to the intake path 34 via a canister 19. As will be described later, the evaporated fuel is mixed with air in the canister 19. The mixture gas of the evaporated fuel and air mixed in the canister 19 is referred to as purge gas. The evaporated fuel path 22 is provided with the evaporated fuel processing device 20.

(Evaporated Fuel Processing Device)

The evaporated fuel processing device 20 includes the canister 19, a purge passage 40, a purge control valve 26, a pump 48, and a controller 102 in the ECU 100. The canister 19 includes an open air port 19*a*, a purge port 19*b*, and a tank port 19*c*. The open air port 19*a* communicates with open air via an open air path 17. The purge port 19*b* is connected to the intake path 34 via a purge path 23. The tank port 19*c* communicates with the fuel tank 14 via a tank path 18.

(Canister)

Activated carbon (not shown) is contained in the canister 19. The evaporated fuel in gas flowing into the canister 19 from the fuel tank 14 through the tank path 18 and the tank port 19*c* adheres to the activated carbon. Gas left after the evaporated fuel has adhered is discharged to open air through the open air port 19*a* and the open air path 17. The canister 19 can prevent the evaporated fuel in the fuel tank 14 from being discharged to open air. The evaporated fuel adhering to the activated carbon is mixed with air introduced from the open air path 17, and is supplied as purge gas to the purge path 23 from the purge port 19*b*.

(Purge Passage)

As described above, the evaporated fuel adhering to the activated carbon is mixed with the air introduced from the open air path 17 and is supplied to the purge path 23 as purge gas. That is, the open air path 17 is a path through which the gas (air) constituting the purge gas passes. The purge passage 40 is configured of the purge path 23 through which the mixture gas of the evaporated fuel and air passes and the open air path 17 through which air passes. The open air path 17 is provided with an air filter 42. The air filter 42 prevents foreign matter in open air from entering the canister 19. A pressure sensor 44 is disposed at an upstream end of the purge passage 40 (the open air path 17) (upstream of the air filter 42). Furthermore, a pressure sensor 28 is disposed at a downstream end of the purge passage 40 (the purge path 23) (downstream of the purge control valve 26). The pressure sensor 44 substantially detects a pressure of external air (atmospheric pressure). The pressure sensor 28 substantially detects a pressure in the intake path.

(Purge Control Valve)

The purge control valve 26 is disposed on the purge path 23. The purge control valve 26 is disposed downstream of the canister 19 (on intake path 34 side relative to the canister 19). The purge control valve 26 is a solenoid valve controlled by the controller 102, and its switching between an open state of being open and a closed state of being closed is controlled by the controller 102. The controller 102 executes duty control which continuously switches the open state and the closed state of the purge control valve 26 according to a duty cycle determined by an air-fuel ratio or the like. In the open state, the canister 19 communicates with the intake path 34, and the purge gas is introduced into the intake path 34. In the closed state, the communication between the canister 19 and the intake path 34 is cut off. The duty cycle refers to a ratio of a duration for the open state to a duration for a pair of the open and closed states which are continuous with each other. The purge control valve 26 adjusts a flow rate of the purge gas by adjusting the duty cycle (that is, by adjusting the switching timing between the open state and the closed state). The purge path 23 is connected to the intake path 34 between the injector 4 and the throttle valve 32. An intake manifold IM is disposed at a position of the intake passage 34 where the purge passage 23 is connected.

(Pump)

The pump 48 is disposed on the purge path 23. The pump 48 is disposed between the canister 19 and the purge control valve 26. The pump 48 is a so-called vortex pump (also called cascade pump or wesco pump) or a centrifugal pump. The pump 48 is controlled by the controller 102. When the pump 48 is driven, the purge gas is sucked from the canister 19 to the pump 48 through the purge passage 40. A pressure of the purge gas sucked into the pump 48 is increased in the pump 48, and then the purge gas is supplied to the intake path 34 through the purge path 23.

(Controller)

The controller 102 is connected to the pressure sensors 28 and 44, the pump 48, and the purge control valve 26. The controller 102 includes a CPU and a memory such as ROM and RAM. Detected values of the pressure sensors 28 and 44 are inputted to the controller 102. The controller 102 controls output of the pump 48 and the duty cycle of the purge control valve 26.

(Purge Process)

When a purge condition is satisfied while the engine 2 is driven, the controller 102 executes a purge process of supplying the purge gas to the engine 2 by executing the duty control on the purge control valve 26. When the purge process is executed, the purge gas is supplied in a direction indicated by an arrow in FIG. 1. The purge condition is a condition that is satisfied when the purge process of supplying the purge gas to the engine 2 is to be executed and is set in the controller 102 by the manufacturer in advance according to cooling water temperature for the engine 2 and concentration of the evaporated fuel in the purge gas (hereinafter referred to as "purge concentration"). The controller 102 constantly monitors whether or not the purge condition is satisfied while the engine 2 is driven. The controller 102 controls the duty cycle of the purge control valve 26 based on the concentration of the purge gas and an airflow meter 39 disposed in the intake path 34. The airflow meter 39 measures an amount of air supplied to the engine 2 through the intake path 34. As such, the purge gas adhering to the canister 19 is introduced into the engine 2.

When executing the purge process, the controller 102 drives the pump 48 to supply the purge gas to the intake path 34. As a result, the purge gas can be supplied even when a negative pressure in the intake path 34 is small. During the purge process, the controller 102 may switch between driving and stopping of the pump 48 depending on the supply state of the purge gas.

The ECU 100 controls the throttle valve 32. The ECU 100 also controls an injected fuel amount by the injector 4. Specifically, the injected fuel amount is controlled by controlling opening time of the valve of the injector 4. When the engine 2 is driven, the ECU 100 calculates a fuel injection time (that is, opening time of the valve of the injector 4), during which fuel is injected from the injector 4 to the engine 2, per unit time. The fuel injection time corrects a reference injection time, which is specified in advance by experiments, in order to maintain the air-fuel ratio at a target air-fuel ratio (for example, an ideal air-fuel ratio). An air-fuel ratio sensor 36 is disposed in an exhaust path 38 of the engine 2. Further, the ECU 100 corrects the injected fuel amount based on the flow rate of the purge gas and the purge concentration.

(Correction for Aperture of Purge Control Valve)

As described above, the ECU 100 corrects the injected fuel amount based on the flow rate of the purge gas and the purge concentration. In an evaporated fuel processing device including no pumps, a flow rate Q of the purge gas can be calculated from a cross-sectional area of the purge passage (the duty cycle of the purge control valve) and a pressure difference ΔP between pressures at both ends of the purge passage. At a specific pressure difference ΔP, the flow rate Q and the duty cycle are approximately proportional.

Figure 3:
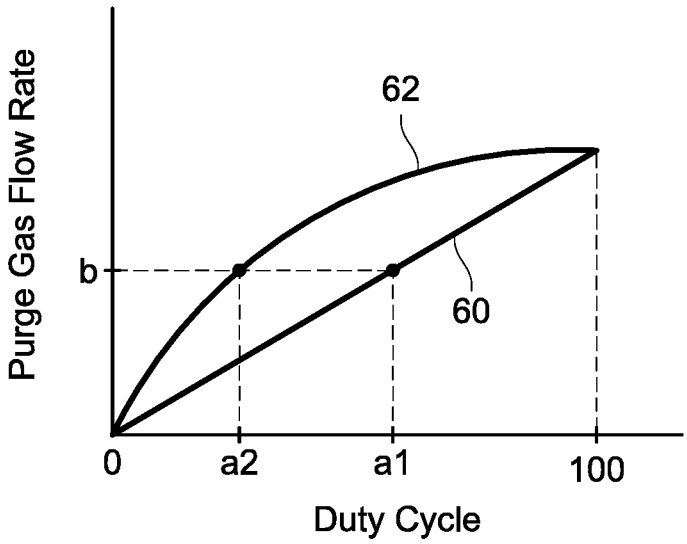
FIG. 3 shows relationships between duty cycle and purge gas flow rate.

FIG. 3 shows relationships between the duty cycle and the flow rate Q at a specific pressure difference ΔP. A curve 60 shows the relationship between the duty cycle and the flow rate Q in an evaporated fuel processing device including no pumps, and a curve 62 shows the relationship between the duty cycle and the flow rate Q in an evaporated fuel processing device including a pump. As shown in FIG. 3, the curve 60 is substantially straight, thus a desired amount of purge gas can be introduced into the intake path simply by controlling the duty cycle of the purge control valve. On the other hand, as shown by the curve 62, the duty cycle and the flow rate Q are not in the proportional relationship with the pump provided. Further, the shape of the curve 62 varies depending on characteristics of the pump. Therefore, in the case of the evaporated fuel processing device 20 described above, a desired amount of purge gas cannot be introduced into the intake path 34 simply by controlling the duty cycle. Therefore, in the evaporated fuel processing device 20, the following process is executed to correct the aperture (duty cycle) of the purge control valve 26.

(Correction Process)

Figure 2:
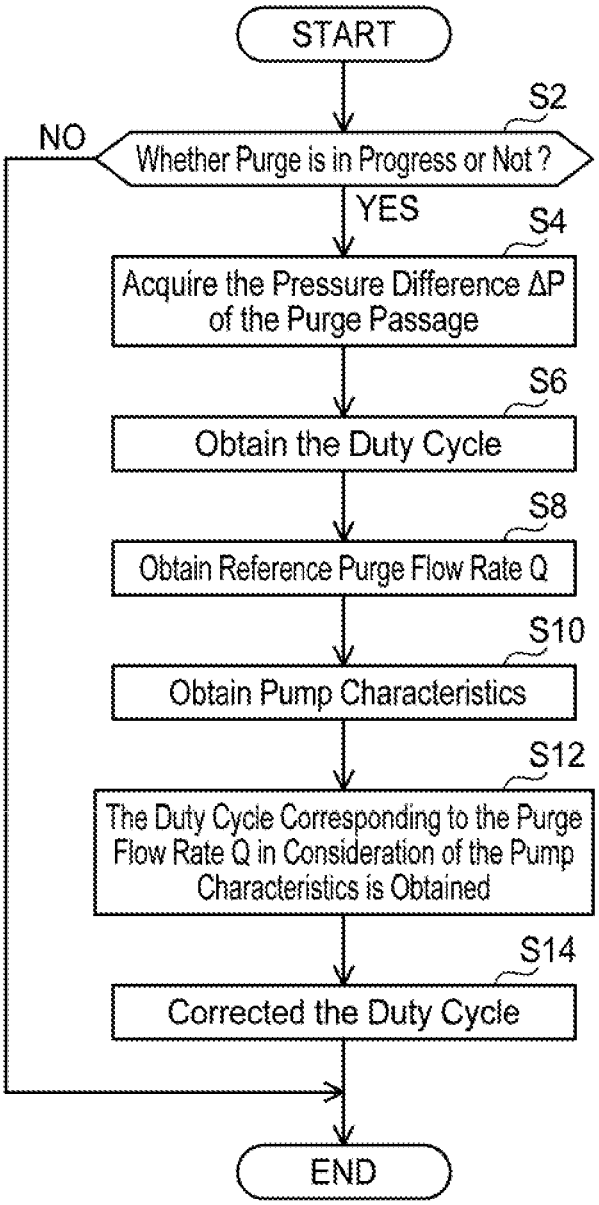
FIG. 2 shows a flowchart of a duty cycle correction process.

FIG. 2 is a flow chart of a correction process for the aperture of the purge control valve 26. This process is executed during purge control (while the purge gas is supplied). Therefore, firstly, whether purge is in progress or not is determined (step S2), and if the purge is not in progress (step S2: NO), the process is terminated. If the purge is in progress (step S2: YES), the pressure difference ΔP of the purge passage 40 is acquired. That is, a pressure at the upstream end of the purge passage 40 is obtained from a detected value of the pressure sensor 44, a pressure at the downstream end of the purge passage 40 is obtained from a detected value of the pressure sensor 28, and the pressure difference ΔP between these pressures is calculated.

Next, the duty cycle under control is obtained (step S6), and a reference purge flow rate Q corresponding to the obtained duty cycle is obtained (step S8). The reference purge flow rate Q is a flow rate corresponding to the duty cycle in the case where no pumps are provided. Therefore, when the pressure difference ΔP and the duty cycle are obtained, the reference purge flow rate Q is uniquely determined.

Next, pump characteristics are obtained (step S10), and the duty cycle that corresponds to the purge flow rate Q in consideration of the pump characteristics is obtained (step S12). The pump characteristics are stored in the controller 102 in advance. Thereafter, the aperture of the purge control valve 26 is corrected to the duty cycle obtained in step S12 (step S14). By the above-described process, a desired amount of purge gas can be supplied to the intake path 34. The duty cycle obtained in step S6 is a duty cycle under control, and the pump characteristics are stored in the controller 102. Therefore, when obtaining the pressure difference ΔP between both ends of the purge passage 40, the evaporated fuel processing device 20 can correct the aperture (duty cycle) of the purge control valve 26 according to the above process, and thus can prevent the supply amount of the purge gas from being deviated.

The process described above will be more specifically described with reference to FIG. 3. When a duty cycle a1 is obtained in step S6, the reference purge flow rate Q (flow rate b) is calculated from the curve 60 (step S8). The curve 62 is obtained from the pump characteristics (step S10), and a duty cycle a2 corresponding to the reference purge flow rate Q (flow rate b) is obtained from the curve 62 (step S12). Thereafter, the duty cycle of the purge control valve 26 is changed (corrected) from a1 to a2, by which a desired amount of purge gas (reference purge flow rate Q) is supplied to the intake path 34.

(Other Embodiments)

As described above, in the evaporated fuel processing device 20, the canister 19, the pump 48, and the purge control valve 26 are disposed in this order from the upstream to the downstream of the purge passage 40. However, this arrangement is merely an example, and the arrangement of the canister 19, the pump 48, and the purge control valve 26 disposed on the purge passage may be arbitrarily changed.

The controller 102 in the above embodiment can be adopted as a controller of an evaporated fuel processing device including a pump, either independently or integrally with the ECU 100.

The pressure difference ΔP between the upstream and downstream ends of the purge passage can also be estimated from a rotational speed of the engine 2 and a flow rate of the air flow meter 39. That is, the pressure sensors 28 and 44 may be omitted.

While specific examples of the present disclosure have been described above in detail, these examples are merely illustrative and place no limitation on the scope of the patent claims. The technology described in the patent claims also encompasses various changes and modifications to the specific examples described above. The technical elements explained in the present description or drawings provide technical utility either independently or through various combinations. The present disclosure is not limited to the combinations described at the time the claims are filed. Further, the purpose of the examples illustrated by the present description or drawings is to satisfy multiple objectives simultaneously, and satisfying any one of those objectives gives technical utility to the present disclosure.

The invention claimed is:

1. An evaporated fuel processing device comprising:

a canister to which evaporated fuel generated in a fuel tank adheres;

a purge passage connecting the canister and an intake pipe of an engine, and through which purge gas to be delivered from the canister to the intake pipe passes;

a purge control valve provided on the purge passage and configured to control a supply amount of the purge gas to the intake pipe by changing a duty cycle;

a pump provided on the purge passage and configured to feed the purge gas from the canister to the intake pipe; and a controller configured to control the duty cycle of the purge control valve, wherein the controller detects a pressure difference between a pressure at an upstream end of the purge passage and a pressure at a downstream end of the purge passage while the purge gas is supplied, and the controller corrects the duty cycle based on a supply amount of the purge gas with respect to the duty cycle with no influence of the pump, by using the detected pressure difference.

2. The evaporated fuel processing device according to claim 1, further comprising pressure sensors that are provided at both the upstream end and the downstream end of the purge passage, respectively.

3. A controller configured to control a purge control valve in an evaporated fuel processing means that supplies purge gas containing evaporated fuel generated in a fuel tank to an intake pipe of an engine, wherein the evaporated fuel processing means comprises:

a canister to which evaporated fuel generated in the fuel tank adheres;

a purge passage connecting the canister and the intake pipe of the engine, and through which purge gas delivered from the canister to the intake pipe passes;

a purge control valve provided on the purge passage and configured to control a supply amount of the purge gas to the intake pipe by changing a duty cycle; and a pump provided on the purge passage and configured to feed the purge gas from the canister to the intake pipe, and the controller is configured to:

detect a pressure difference between a pressure at an upstream end of the purge passage and a pressure at a downstream end of the purge passage while the purge gas is supplied; and correct the duty cycle based on a supply amount of the purge gas with respect to the duty cycle with no influence of the pump, by using the detected pressure difference.

* * * * *